United States Patent [19]

Akman

[11] 4,143,630

[45] Mar. 13, 1979

[54] ALTITUDE INSENSITIVE AUTOMOTIVE ENGINE INGNITION TIMING CONTROL

[75] Inventor: Ahmet R. Akman, Farmington, Mich.

[73] Assignee: Ford Motor Company, Dearborn, Mich.

[21] Appl. No.: 851,241

[22] Filed: Nov. 14, 1977

[51] Int. Cl.[2] ..... F02P 5/04; F02M 25/06

[52] U.S. Cl. ..... 123/117 A; 123/117 R; 123/119 A

[58] Field of Search ..... 123/117 A, 117 R, 146.5 A, 123/119 A

[56] References Cited

U.S. PATENT DOCUMENTS

| | | | |
|---|---|---|---|
| 2,470,366 | 5/1949 | Ostling | 123/117 A |
| 3,203,411 | 8/1965 | Seidlen | 123/117 A |
| 3,561,411 | 2/1971 | Vasilescu et al. | 123/117 A |
| 3,659,501 | 5/1972 | Beard | 123/117 A |
| 3,704,697 | 12/1972 | Weymann | 123/117 R |
| 3,780,713 | 12/1973 | Julian | 123/117 A |
| 3,915,132 | 10/1975 | Thornburgh | 123/117 A |

*Primary Examiner*—Charles J. Myhre
*Assistant Examiner*—P. S. Lall
*Attorney, Agent, or Firm*—Robert E. McCollum; Keith L. Zerschling

[57] ABSTRACT

An automotive type engine has an ignition timing control that includes a vacuum controlled servo that is responsive to spark port vacuum changes to provide a first advance increment, and EGR port vacuum providing an additional incremental advance, coupled with a source of air at constant pressure acting on the servo as a reference pressure to render the ignition timing changes insensitive to barometric pressure changes occasioned by changes in altitude of the vehicle in which the timing control servo is installed.

10 Claims, 2 Drawing Figures

ALTITUDE INSENSITIVE AUTOMOTIVE ENGINE INGNITION TIMING CONTROL

Figure 1:
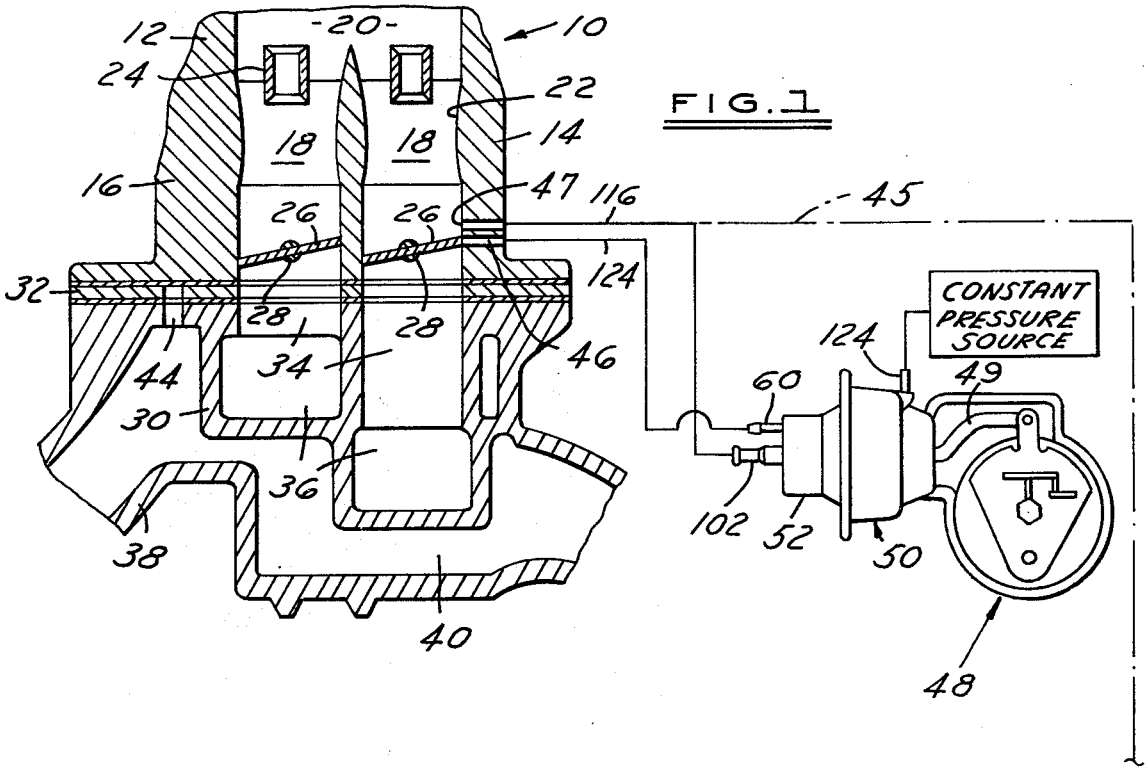

This invention relates in general to an automotive type, vacuum controlled, engine ignition timing control and more particularly to one that is insensitive to altitude changes of the vehicle in which it is installed.

This invention relates in particular to an emission control system for an automotive type internal combustion engine in which the ignition timing is advanced in a conventional manner by the use of part throttle spark port vacuum, and an additional increment of timing advance is provided when exhaust gas recirculation (EGR) takes place, to compensate for the slower burn rate that the EGR causes. In this particular installation, vacuum is used as the EGR signal pressure to actuate the EGR valve; simultaneously, the same vacuum is fed to the distributor breaker plate actuator servo to change the ignition timing to compensate for the EGR flow varying the burn rate of the air/fuel mixture supplied to the engine cylinders.

Systems for providing a dual advance of the engine ignition timing, whether to compensate for the addition of EGR or for other purposes, are known in the prior art. For example, my copending patent application Ser. No. 848,637, filed Nov. 4, 1977, and entitled Engine Ignition Timing Control, shows and describes such a system, as do U.S. Pat. No. 4,040,401, Marsee; U.S. Pat. No. 3,626,914, Brownson; U.S. Pat. No. 3,780,713; and U.S. Pat. No. 3,915,132, Thornburgh. All of the latter references show devices for providing a progressive advance of the engine ignition timing. None of the references, however, shows any means for rendering the devices insensitive to barometric pressure changes caused by changes in altitude of the vehicle or engine in which the ignition control device is installed. Under such conditions, as the vehicle moves to a high altitude, for example, the lower barometric pressure results in a lower manifold pressure level for the same throttle valve opening and EGR flow as at lower levels. As a result, the lower vacuum forces acting on the servo mechanisms of the distributor ignition timing control cause the ignition timing to be less advanced as the altitude increases, i.e., the ignition timing varies inversely with changes in altitude. Conversely, if the vacuum force level on an actuator diaphragm is maintained the same, then the drop in atmospheric pressure level opposing the vacuum force causes an increase in advance movement. Both of these results are undesirable.

It is a primary object of this invention to provide an automotive type engine ignition timing control that is insensitive to barometric pressure changes resulting from changes in altitude of the vehicle in which the control is installed.

Devices are known for compensating for changes in altitude to maintain the same engine timing advance setting for a given input. However, these devices compensate rather than render the device insensitive to the changes. Accordingly, it is necessary to vary the actuating force with changes in barometric pressure to maintain the same effective force. This results in a more complicated and costly device and one harder to control since two forces are changing rather than just one.

The invention provides an automotive type engine ignition timing control in which a constant pressure source is used to maintain the same reference pressure in the servo actuator against which the engine vacuum changes are applied so that the engine timing advance or retard remains the same for the same engine operating conditions regardless of changes in barometric pressure due to altitude changes.

It is another object of the invention, therefore, to provide a multi-advance engine spark timing control for an automotive type engine that is insensitive to altitude changes to provide the same ignition timing setting for the same engine operating conditions at all barometric pressure levels.

Figure 2:
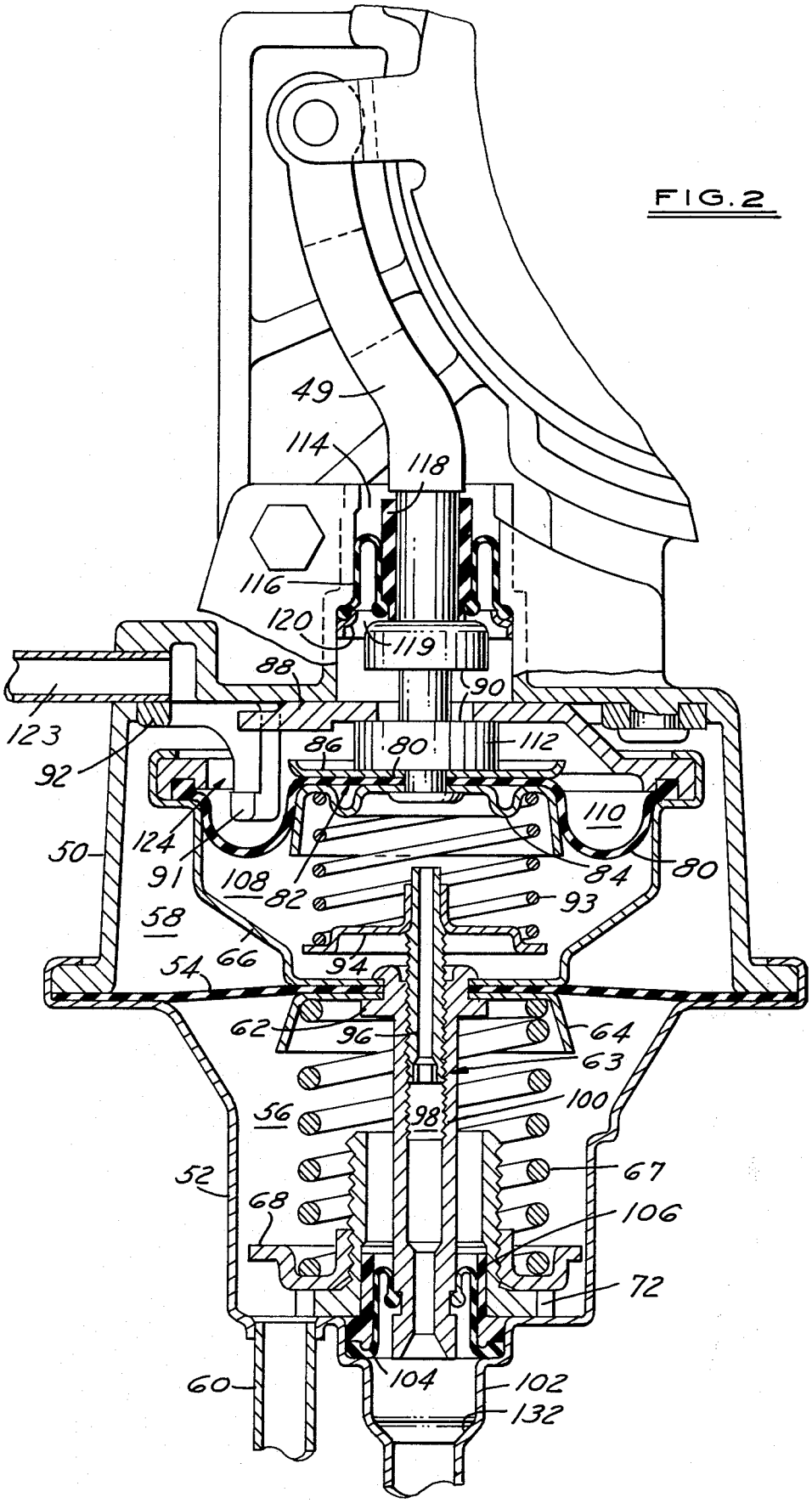

Other objects, features and advantages of the invention will become more apparent upon reference to the succeeding detailed description thereof, and to the drawings illustrating the preferred embodiments thereof; wherein, FIG. 1 is a schematic illustration of an internal combustion engine emission control system including a spark timing control embodying the invention; and, FIG. 2 is an enlarged cross-sectional view of a detail of the FIG. 1 showing.

FIG. 1 illustrates a portion 10 of a two-barrel carburetor of a known downdraft type. It has an air horn section 12, a main body portion 14, and a throttle body 16, joined by suitable means, not shown. The carburetor has a pair of air/fuel induction passages 18 open at their upper ends 20 to fresh air from the conventional air cleaner, not shown. The passages 18 each have a fixed area venturi 22 cooperating with a booster venturi 24 through which the main supply of fuel is induced, by means not shown.

Flow of air and fuel through induction passages 18 is controlled by a pair of throttle valve plates 26 each fixed on a shaft 28 rotatably mounted in the side walls of the carburetor body.

The throttle body 16 is flanged as indicated for bolting to the top of the engine intake manifold 30, with a spacer element 32 located between. Manifold 30 has a number of vertical risers or bores 34 that are alligned for cooperation with the discharge end of the carburetor induction passages 18. The risers 34 extend at right angles at their lower ends 36 for passage of the mixture out of the plane of the figure to the intake valves of the engine.

The exhaust manifolding part of the engine cylinder head is indicated partially at 38, and includes an exhaust gas crossover passage 40. The gases pass from the exhaust manifold, not shown, on one side of the engine to the opposite side beneath the manifold trunks 36 to provide the usual "hot spot" beneath the carburetor to better vaporize the air/fuel mixture.

The spacer 32 is provided with a recess that is connected directly to crossover passage 40 by a bore 44. The recess in the spacer is connected to a passage, not shown, that is alternately blocked or connected to a central bore or passage communicating with the risers 34. A conventional exhaust gas recirculating (EGR) valve, not shown, controls the flow of EGR to the risers. The details of construction and operation of the EGR valve are not given since they are known and believed to be unnecessary for an understanding of the invention.

Suffice it to say that the EGR valve is spring closed and moved to an open position by a vacuum controlled servo that is connected to an EGR vacuum signal line 45. Line 45 is connected to the carburetor induction passage, in a manner to be described later.

A part throttle spark advance pressure sensitive port 46 is tapped into the induction passage at a point just above or aligned with the idle position of throttle valve 26, to be traversed by the edge of each throttle valve during its opening part throttle movements. This will change the pressure level in spark port 46 as a function of the rotative position of the throttle valve. The spark port will reflect the essentially atmospheric pressure in the air inlet upon closure of the throttle valve, and progressively decrease to the level of the intake manifold vacuum as the throttle valve opens. A second EGR pressure sensitive port 47 is located above the spark port so that the EGR port sees vacuum later than the spark port because it is uncovered later, for a purpose that will become clear later. This port 47 is connected to EGR vacuum line 45.

FIG. 1 also shows schematically an engine distributor 48 that includes an essentially reciprocating lever 49 that moves leftwardly in a spark advance direction, or rightwardly in a spark return direction. The movement is controlled by the vacuum servo 50.

FIG. 2 shows the details of construction of the multistage ignition timing control servo 50. More particularly, the servo consists of a main housing 51 and a bell shaped-like cover 52 between which is edge mounted an annular flexible diaphragm 54. The diaphragm acts as a common movable wall between a spark port vacuum chamber 56 and a constant pressure chamber 58. The vacuum chamber 56 is connected by an adapter nipple 60 to the carburetor part throttle spark port 46 shown in FIG. 1.

Diaphragm 54 is secured centrally by end portions 62 of a tube 63 between a spring retainer 64 and the inner diameter of an inner housing 66. A spring 67 is seated at one end against retainer 64 and at the other end against a second retainer 68. The latter is adjustably threaded onto an adjusting screw sleeve 70. A pinion tool, not shown, with teeth on its end, can be inserted through the nipple 60 to engage teeth 72 on the sleeve 70 to rotate the sleeve to adjust the position of retainer 68 and thus adjust the preload of spring 67.

The distributor timing change lever 49 is fixed to the inner edge 80 of the second annular flexible diaphragm 82 that provides the additional advance proportional to EGR flow described previously. The diaphragm inner edge 80 is sandwiched between a spring retainer 84 and a second retainer disc 86. The outer edge of diaphragm 82 is located between the outer diameter of inner housing 66 and the outer edge portion of a stop plate 88. The stop plate is loosely mounted on lever 49 to axially float between a pair of shoulders 90. The stop plate is limited in its forward or advance movement by abutment against a pair (only one shown) of hook-like stops 91 that are circumferentially spaced and project from a base plate 92 screwed to housing 51.

Diaphragm 82 normally is biased upwardly as shown in FIG. 2 by a spring 93 that seats at one end against retainer 84 and at the opposite end against a retainer 94. Retainer 94 is fitted onto a tubular adjusting screw 96 that screws into a vacuum passage 98 in tube 63. The lower end 100 of tube 63 is floatingly mounted to move axially into an adapter nipple 102 formed as part of housing 52. The passage 98 is sealed from vacuum chamber 56 by a rolling type annular seal 104 that also mounts the end of tube 63. The seal 104 has one end secured on the tube end 100 and the other end sandwiched between the nipple 102 and a retainer sleeve 106. The adapter nipple 102 is connected by the hose 45 to the EGR port 47 (FIG. 1). The preload of spring 93 can be adjusted by inserting the end of a hex head tool, not shown, through nipple 102 and tube 98 into screw 96 to vary the position of retainer 94.

The construction described above then defines a second vacuum chamber 108 between the inner housing 66 and the diaphragm 82, and a constant pressure chamber 110 between the diaphragm 82 and the stop member 88. The diaphragm thus is a common movable wall between the chambers. The preloaded spring 93 biases diaphragm 82 upwardly until an enlargement 112 on lever 49 abuts against the stop member 88.

Completing the construction, the space 114 between lever 49 and housing 51 is sealed from ambient outside pressure conditions by a second rolling seal member 116. The latter is mounted internally between a retaining sleeve 118 fixed on lever 49 and an enlargement 119 on lever 49, and externally between a shoulder on housing 51 and a retainer 120.

Housing 50, as seen in FIG. 1, has an adapter connected with a passage 123 leading to an opening into chamber 58. The adapter is connected by a line 124 (FIG. 1) to any suitable source of air at constant pressure indicated schematically at 130 to act against the back sides of both diaphragm 54 and secondary diaphragm 82.

The operation of the ignition control, in brief, is as follows. Lever 49 is shown in an initial set timing position, which may be advanced or retarded, by a number of degrees, or at a zero top dead center position, as desired. The part throttle advance spring 67 locates the part throttle diaphragm 54 as shown pushing the inner cover 66 and housing 88 against the stationary housing 51. At the same time, the secondary diaphragm spring 93 pushes the retainer 84 and lever 49 against the stop member 88. Ambient air pressure is present in chambers 56 and 108. Constant pressure air may or may not be present in chambers 58 and 110 depending upon whether the source 130 is engine driven or independently supplied.

With the engine started, chambers 58 and 110 will be at a constant or fixed reference pressure level from source 130. Depression of the throttle pedal then provides part throttle vacuum from the spark port 46 to the nipple 60 to vacuum chamber 56 to act on diaphragm 54. Once the preload of spring 67 is overcome, diaphragm 54 will move leftwardly pulling the inner housing 66 and stop member 88 in the same direction. The stop member 88, therefore, moves lever 49 in the same direction. This will continue upon continued increase in the part throttle spark port vacuum until the stop plate 88 abuts against the hook-like ends 91 of plate 92. At this time, the part throttle advance will be halted.

In addition to the above advance movement, as soon as the throttle valve begins to traverse the EGR port 47, the ambient air pressure present in chamber 108 will begin to be replaced by vacuum. When this vacuum, which is flowing simultaneously to the EGR valve actuator, is sufficient to trigger the EGR valve to open, this same pressure in chamber 108 will act on the secondary diaphragm 82 pulling retainer 84 and lever 49 downwardly against the resistance of spring 93. Assuming that the preload of spring 93 is overcome at the same time the EGR valve opens, the secondary diaphragm 82 moves downwardly to move lever 49 in the advance direction an amount that is additional to that already provided by the part throttle advance diaphragm 54. The amount or distance travelled will be limited by abutment of the shoulder 90 on lever 49 against the stop member 88 to stop the additional advance movement.

Thus, the distributor actuator servo will provide a conventional part throttle vacuum advance and an additional advance distance proportional to the EGR flow. Ignition timing thus will be advanced as EGR flow occurs to compensate for the slower burning rate of the mixture resulting from adding exhaust gases to the engine intake charge.

In addition, each vacuum level in chambers 56 and 108 will provide the same travel movement of lever 49 regardless of ambient/atmospheric pressure conditions because the reference pressure on the opposite sides of the diaphragms 54 and 82 in chambers 56 and 110 is constant. Thus, even though the vehicle moves between higher and lower altitudes, with a consequential change in barometric pressures, the diaphragm travels will remain the same for the same vacuum force applied.

While the invention has been shown and described in its preferred embodiment, it will be clear to those skilled in the art to which it pertains that many changes and modifications may be made without departing from the scope of the invention.

I claim:

1. An altitude insensitive ignition timing control for an automotive type internal combustion engine having a carburetor mounted thereon having an induction passage connected to the engine intake manifold and a throttle valve movable across the passage to control the flow of an air/fuel mixture therethrough to the intake manifold, first and second pressure ports opening into the passage axially spaced from one another along the passage and one of which is located above the closed position of the throttle valve in a position to be traversed by the edge of the throttle valve as it moves between a closed and open position to subject the one pressure port to manifold vacuum changes, an engine ignition timing distributor having movable ignition timing change means movable in an advance direction from an initial timing set position to advance the ignition timing and in an opposite direction to return the ignition timing to the set position, a source of constant pressure, and fluid pressure actuated control means connected to said movable means and responsive to the application of the pressures from the pressure ports to move the distributor movable means to effect an advance of the engine timing by various degrees, said control means comprising a servo mechanism having first and second separated vacuum chambers with first and second movable walls, respectively, each wall operatively connected to the distributor movable means, means connecting the first and second pressure ports respectively to the first and second chambers to act on one side of each of the first and second movable walls, respectively, whereby application of vacuum from the ports to the chambers moves the movable walls as a function of the vacuum changes to independently and/or concurrently advance the engine timing by an amount that varies as a function of the pressures in the ports, first and second spring means biasing the first and second movable walls, respectively, towards the initial set position, and means connecting the constant pressure source to the opposite side of at least one of the movable wall means whereby the one wall means maintains the same position attained for the same level of vacuum applied to the wall means regardless of barometric pressure changes in response to altitude changes.

2. A control as in claim 1, the second pressure port being located above the first port in a position to be traversed by the throttle valve in its opening movement subsequent to traverse of the first port whereby the second wall means is moved to provide an advance movement that is additional to the advance provided by movement of the first wall means.

3. A control as in claim 1, the servo including a housing, the first movable wall means comprising a flexible diaphragm dividing the housing into the first vacuum chamber and another chamber, means connecting the other chamber to the constant pressure source to provide the same advance movement of the diaphragm for the same vacuum force level applied thereto regardless of barometric pressure level changes in response to altitude changes of the vehicle.

4. A control as in claim 3, the housing surrounding an inner housing connecting to the diaphragm at one end and to the distributor movable means at the other end, a second flexible diaphragm dividing the inner housing into the second vacuum chamber and a further chamber connected to the constant pressure source, the second diaphragm constituting the second movable wall means.

5. A control as in claim 4, the inner housing being contained within the other chamber.

6. A control as in claim 1, the first and second chambers being contiguous, the means connecting the pressure ports to the chambers including a conduit projecting through the first chamber into the second chamber.

7. A control as in claim 6, the movable wall means each comprising a flexible diaphragm and being coaxially spaced and essentially parallel with respect to one another.

8. An altitude insensitive ignition timing control for an automotive type internal combustion engine having a carburetor mounted thereon having an induction passage connected to the engine intake manifold and a throttle valve movable across the passage to control the flow of an air/fuel mixture therethrough to the intake manifold, a first part throttle pressure spark port and a second exhaust gas recirculating (EGR) pressure port opening into the passage axially spaced from one another along the passage and located above the closed position of the throttle valve in a position to be traversely progressively by the edge of the trottle valve as it moves between a closed and wide open position to subject the pressure ports to manifold vacuum changes, an engine ignition timing distributor having movable ignition timing change means movable in one advance direction from an initial set timing position to advance the ignition timing and in an opposite return direction, a source of constant pressure, and fluid pressure actuated control means connected to said movable means and responsive to the progressive application of the vacuums from the spark and EGR pressure ports to move the movable means to effect advance of the engine timing by various degrees, said control means comprising a servo mechanism having a multi-part housing and a pair of separated flexible diaphragms together with parts of the housing defining first and second separated vacuum chambers, means operatively connecting the diaphragm of each chamber to the distributor movable means, means connecting the spark port and EGR pressure port respectively to the first and second chambers to one side of the first and second diaphragms, respectively, whereby application of vacuum from the spark port to the first chamber as the throttle valve opens moves the first diaphragm to advance the engine timing a first amount, and application of vacuum from the EGR port to the second chamber as the throttle valve opens wider moves the second diaphragm to advance the ignition timing a second amount, first and second spring means biasing the first and second diaphragms, respectively, in a return direction, and means connecting the constant pressure source to the opposite side of each diaphragm whereby each of the diaphragms maintains the same position attained for the same level of vacuum applied to the respective diaphragm regardless of barometric pressure changes in response to altitude changes.

9. A control as in claim 8, the first diaphragm dividing the housing into a part throttle spark port vacuum chamber connected to the spark port and another chamber connected to the source of constant pressure, an inner housing connected to the first diaphragm and operatively abutting the distributor movable means during movement of the inner housing in an advance direction, the second diaphragm dividing the inner housing into an EGR port vacuum chamber connected to the EGR port and a further chamber connected to the source of constant pressure, the second diaphragm being movable by EGR vacuum in an advance direction relative to the inner housing and to the first diaphragm.

10. A control as in claim 9, including EGR port pressure conduit means projecting through the spark port vacuum chamber into the EGR port vacuum chamber.

* * * * *